United States Patent [19]

Liegel

[11] Patent Number: 4,715,573

[45] Date of Patent: Dec. 29, 1987

[54] CONVERTIBLE TOOL TRAY AND SUPPORT STAND FOR MECHANICS TOOL

[75] Inventor: Reinald D. Liegel, Waukesha, Wis.

[73] Assignee: Hein-Werner Corporation, Waukesha, Wis.

[21] Appl. No.: 934,997

[22] Filed: Nov. 26, 1986

[51] Int. Cl.[4] ..... A47G 29/00

[52] U.S. Cl. ..... 248/129

[58] Field of Search ..... 248/129, 132, 146, 125; 108/27, 28, 146, 144, 147; 211/70.1, 70.6, 71, 133; 280/47.34, 79.2, 79.3; 312/DIG. 33

[56] References Cited

U.S. PATENT DOCUMENTS

| | | | |
|---|---|---|---|
| 1,409,609 | 3/1922 | Stockle | 248/125 X |
| 1,667,669 | 4/1928 | Megee | 248/125 X |
| 2,628,147 | 2/1953 | Berner | 108/147 UX |
| 3,210,846 | 10/1965 | Balkin | 108/147 X |
| 3,339,938 | 9/1967 | Edmisson | 248/124 X |
| 3,393,649 | 7/1968 | Miotke | 108/147 |
| 4,119,044 | 10/1978 | Hines | 280/47.34 X |
| 4,488,497 | 12/1984 | Bevans | 108/144 |
| 4,509,649 | 4/1985 | Evans | 211/70.6 |
| 4,535,897 | 8/1985 | Remington | 280/47.34 X |

*Primary Examiner*—J. Franklin Foss

*Attorney, Agent, or Firm*—Michael, Best & Friedrich

[57] ABSTRACT

A tool tray for supporting tools for use by a mechanic working beneath a vehicle. The tool tray includes a plurality of casters and a vertically adjustable stand for selectively supporting the tool tray in an elevated position wherein the height of the tool tray is adjustable.

7 Claims, 3 Drawing Figures

CONVERTIBLE TOOL TRAY AND SUPPORT STAND FOR MECHANICS TOOL

FIELD OF THE INVENTION

The invention relates to apparatus for use in supporting mechanics tools beneath a vehicle in a manner wherein the tools are readily accessible to a mechanic performing maintenance work on a vehicle.

BACKGROUND PRIOR ART

Work by a mechanic on a vehicle can be accomplished more efficiently if the mechanic's tools are supported such that they are readily available to the mechanic and such that the mechanic can remain in the working position while having access to all of the tools needed to accomplish the maintenance operation. If the mechanic must move between a work position and a tool area, the maintenance operation is substantially more time consuming and labor intensive.

Additionally, in many repair applications, the mechanic may work beneath a vehicle supported on a hydraulic lift. In such applications the mechanic will stand beneath the vehicle and the tools should be supported such that they are elevated and positioned within easy reach of the mechanic. In other operations, the vehicle may be supported on the ground, and the mechanic will work under the vehicle on a mechanics creeper. Efficiency requires that the tools be readily accessible to the mechanic when he is working in this position such that he is not required to repeatedly move from under the vehicle in order to obtain tools.

SUMMARY OF THE INVENTION

The invention provides an improved apparatus for use in supporting mechanics tools such that they are conveniently accessible to a mechanic working beneath a vehicle. The apparatus includes a generally horizontal tool support tray and a vertical stand providing means for supporting a tray for adjustable vertical movement, to permit the height of the tray to be varied depending upon the height of the vehicle when the vehicle is supported on a hydraulic vehicle lift, and for movement of the tray assembly to various work positions beneath the vehicle. The tool support tray also includes a plurality of casters mounted on the bottom of the tray, and the tool support tray is removably supported by the vertical stand such that the tray can be removed from the vertical stand and supported on the floor for movement along the floor on the casters.

More particularly, the invention includes a tool tray assembly including a tool tray having an upper surface adapted for use in supporting a plurality of mechanics tools, and wheels attached to the bottom surface of the tool tray for supporting the tool tray for movement along the ground. The tool tray assembly also includes a base, means for supporting the base for movement along the ground and a vertically extending member supported by the base and extending upwardly from the base, the vertically extending member including an upper end, and means for removably mounting the tool tray on the upper end of the vertical member with the tool tray and the wheels supported above the ground.

In one embodiment of the invention the vertically extending member comprises a vertically extending tube supported by the base and having an upper end, and a telescoping tube housed in the upper end of said vertically extending tube.

In one embodiment of the invention the means for removably mounting the tool tray on the upper end of the vertically extending member includes a mounting member fixed to the bottom surface of the tool tray and releaseably engageable with the upper end of the vertically extending member.

Various additional features and various advantages of the invention will be apparent by reference to the following description of a preferred embodiment, from the drawings and from the claims.

Figures 1, 2, 3:
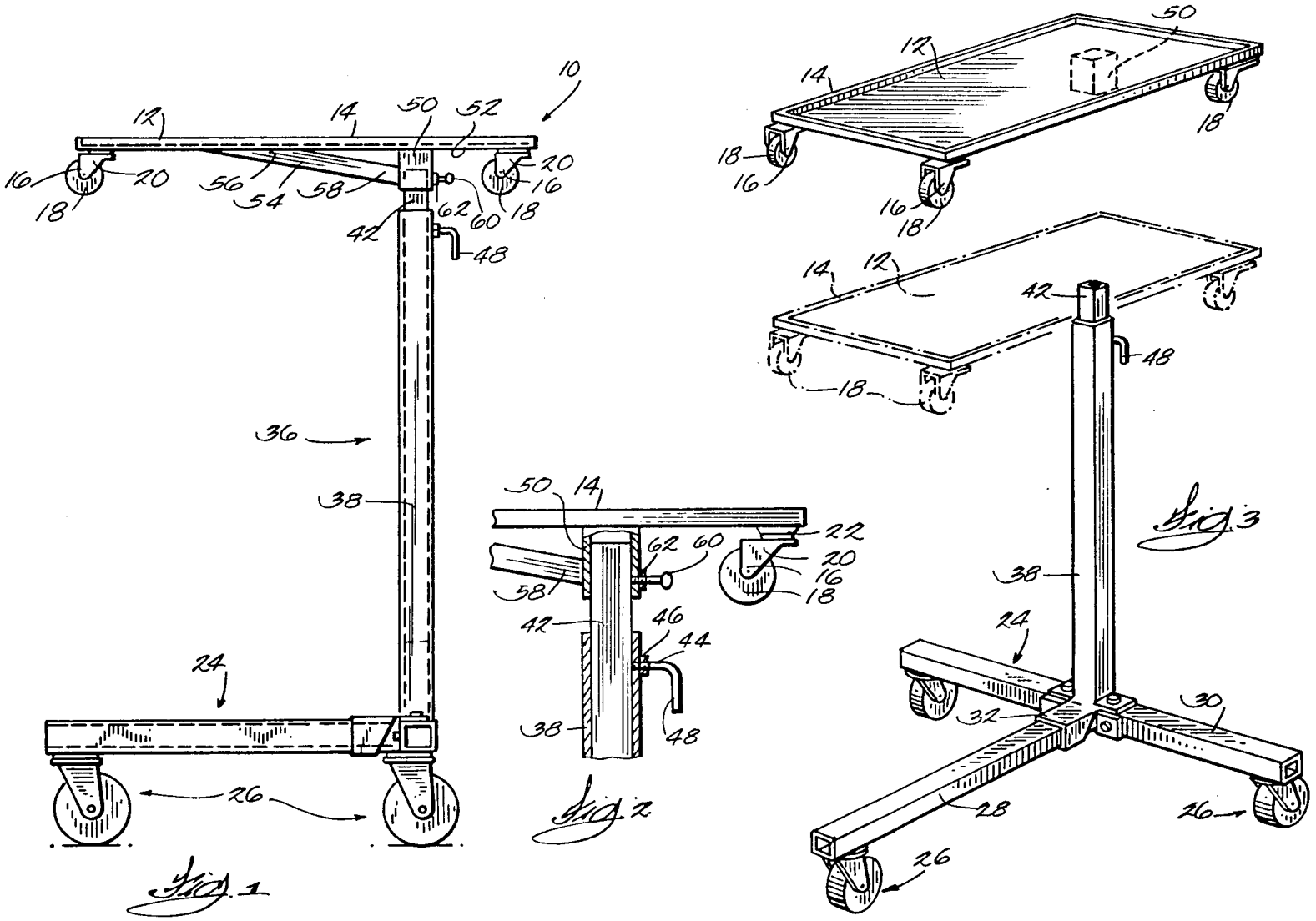
FIG. 1 is a side elevation view of a tool tray assembly embodying the invention.
FIG. 2 is an enlarged partial view of apparatus illustrated in FIG. 1 and with portions shown in cross section.
FIG. 3 is an exploded perspective view of the tool tray assembly illustrated in FIG. 1.

Before describing at least one embodiment of the invention in detail, it is to be understood that the invention is not limited in its application to the details of construction and to the specific arrangement set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Illustrated in FIG. 1 is a tool tray assembly 10 embodying the invention and including a generally flat planar tray 12 having an upper surface adapted to support a plurality of mechanics tools. In the illustrated arrangement the flat planar tray 12 includes a flange 14 extending upwardly from the peripheral edges of the tray and defining a restraining lip.

Means are also provided for supporting the tray for movement along the ground. In the illustrated arrangement that means includes a plurality of casters 16 mounted on the bottom surface of the tray, the casters 16 being shown as positioned at the corners of the tray. The casters 16 are conventional and each comprise a wheel 18 supported by a yoke 20, and the yoke 20 is mounted to the bottom surface of the tray by a conventional ball bearing assembly 22 which provides for free rotation of the yoke 20 about a vertical pivot axis.

The tool tray assembly 10 also includes a base or frame 24 supported by a plurality of casters 26 for movement along the ground. While the base 24 could have other constructions, in the illustrated arrangement, the base is comprised of a generally T-shaped assembly comprised of a horizontally extending leg 28 rigidly joined to a horizontal cross member 30. In the specific instructions shown in the drawings, the leg 28 and cross member 30 of the base 24 are comprised of tubes which are square in cross section. A socket assembly 32 bolted to the cross member 30 provides means for rigidly connecting the leg 28 to the cross member 30.

The tool tray assembly 10 also includes a vertically extending support 36 having a lower end supported by a mid-portion of the cross member 30 and an upper end adapted to selectively support the tool tray 12. In the illustrated construction the vertically extending support 36 comprises a vertically etending elongated tubular member 38 being square in horizontal cross section and having an upper end being adapted to slideably house an elongated support member 42 in telescoping relation, and supporting that telescoping member 42 for vertical adjustable movement. In a preferred form of the invention the internal cross sectional configuration of the upper end of the vertically extending member 38 has internal dimensions slightly larger than the outside dimensions of the telescoping support member 42 such that the telescoping support member 42 is vertically slideably movable within the vertically extending support member 38.

Means are also provided for releaseably and adjustably varying the vertical position of the telescoping member 42 within the vertically extending support member 38. In the illustrated arrangement a set screw 44 is provided, the set screw 44 being threaded through a nut 46 welded to the vertical support member 38 and having an inwardly extending end engageable with the telescoping member 42 to releaseably secure it in place. In the illustrated arrangement the set screw 44 also includes an L-shaped end portion 48 functioning as a handle.

Means are also provided for removably mounting the tool tray 12 on the upper end of the vertically telescoping support member 42. In the illustrated arrangement, the means for movably mounting includes a socket member 50 projecting from the bottom surface 52 of the tool tray. The socket member 50 comprises a tubular sleeve having an upper end welded to the bottom surface 52 of the tool tray, and the sleeve being adapted to slideably house the upper end of the telescoping support member 42. In the illustrated arrangement a gusset 54 includes one end 56 welded to the bottom surface of the tool tray 12 in spaced relation from the tubular sleeve 50 and includes an opposite end 58 welded to a lower portion of the tubular sleeve 50 and is intended to provide support for the tubular sleeve end of the tool tray spaced from the tubular sleeve 50. A set screw 60 is threadably housed in a nut 62 welded to the tubular sleeve 50 to provide a means for releaseably fixing the sleeve to the upper end of the telescoping support member 42.

In operation of the tool tray 12 illustrated in the drawings, the tool tray can be conveniently mounted on the stand and used by a mechanic when the mechanic works beneath a vehicle supported on a hydraulic lift. The vertical position of the tool tray can be readily adjusted by the mechanic such that the tool tray is positioned at a height which is convenient to the mechanic while he is working beneath the vehicle. The tool tray 12 can also be removed from the stand and can be used by a mechanic working under a vehicle supported on the ground. As the mechanic completes his work on a vehicle supported on a hydraulic lift and moves to a vehicle supported on the ground, the mechanic is not required to move his tools to a second tool tray. He can remove the tool tray 12 from the telescoping support member 42 and roll the tool tray beneath the vehicle supported on the ground.

Various features of the invention are set forth in the following claims.

I claim:

1. A tool tray assembly for use in supporting tools used by a mechanic beneath a vehicle, the tool tray assembly comprising:

a tool tray having an upper surface adapted for use in supporting a plurality of mechanics tools, and said tool tray including a bottom surface, means for supporting the tool tray for movement along the ground, the means for supporing including a plurality of wheels attached to said bottom surface of said tool tray and adapted to independently support said tool tray for movement along the ground.

a base, means for supporting said base for movement along the ground, a vertically extending member supported by said base and extending upwardly from said base, said vertically extending member including an upper end, and means for removably mounting said tool tray on said upper end of said vertical member with said tool tray and said plurality of wheels supported above the ground, said means for removably mounting said tool tray on said upper end of said vertical member including a mounting member fixed to the bottom surface of said tool tray, said mounting member being releasably engageable with said upper end of said vertically extending member so as to removably support said tool tray on said upper end.

2. A tool tray assembly as set forth in claim 1 wherein said vertically extending member includes means for adjusting the height of said tool tray above the ground.

3. A tool tray assembly as set forth in claim 1 wherein said vertically extending member comprises a first vertically extending tube supported by said base and having an upper end, and a second vertically extending tube housed in said upper end of said first vertically extending tube in telescoping relation.

4. A tool tray assembly as set forth in claim 3 further including means for adjustably securing the position of said second vertically extending tube with respect to the position of said first vertically extending tube.

5. A tool tray assembly as set forth in claim 1 wherein said mounting member comprises a tube defining a socket and having a generally vertically extending longitudinal axis, said tube having an upper end fixed to said bottom surface of said tool tray and an open lower end adapted to house said upper end of said vertically extending member.

6. A tool tray assembly as set forth in claim 1 wherein said means for supporting said tool tray for movement over the ground includes a plurality of casters fixed to said bottom sufrace of said tool tray and extending downwardly from said tool tray.

7. A tool tray assembly as set forth in claim 6 wherein said means for supporting said base for movement along the ground includes a plurality of casters supporting said base for movement over the ground.

* * * * *